US007556367B2

(12) United States Patent
Langford et al.

(10) Patent No.: US 7,556,367 B2
(45) Date of Patent: Jul. 7, 2009

(54) INK DELIVERY SYSTEM AND A METHOD FOR REPLACING INK

(75) Inventors: Jeffrey D Langford, Lebanon, OR (US); Harold F Mantooth, Vancouver, WA (US); Carrie E Harris, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 97 days.

(21) Appl. No.: 11/961,020

(22) Filed: Dec. 20, 2007

(65) Prior Publication Data

US 2008/0252706 A1 Oct. 16, 2008

Related U.S. Application Data

(63) Continuation of application No. 10/976,670, filed on Oct. 29, 2004, now Pat. No. 7,331,664.

(51) Int. Cl.
*B41J 2/18* (2006.01)

(52) U.S. Cl. ..... 347/89

(58) Field of Classification Search ..... 347/21, 347/28, 85, 87, 89
See application file for complete search history.

(56) References Cited

U.S. PATENT DOCUMENTS

| | | | | |
|---|---|---|---|---|
| 4,462,037 | A * | 7/1984 | Bangs et al. | 347/85 |
| 4,929,963 | A * | 5/1990 | Balazar | 347/89 |
| 5,296,875 | A * | 3/1994 | Suda | 347/93 |
| 5,561,448 | A * | 10/1996 | Kaneko et al. | 347/29 |
| 5,751,300 | A * | 5/1998 | Cowger et al. | 347/6 |
| 5,936,650 | A * | 8/1999 | Ouchida et al. | 347/89 |
| 5,956,062 | A * | 9/1999 | Omata et al. | 347/89 |
| 6,435,647 | B2 * | 8/2002 | Faisst et al. | 347/28 |
| 6,742,861 | B2 * | 6/2004 | McCarty | 347/29 |
| 7,182,420 | B2 * | 2/2007 | Nakazawa | 347/7 |

* cited by examiner

*Primary Examiner*—Anh T. N. Vo

(57) ABSTRACT

An ink delivery system having a fluid supply and a printhead assembly, separate from and in fluid communication with the fluid supply. A primary flow path is configured to facilitate the delivery of fluid from the fluid supply to the printhead assembly, and a return flow path, at least partially separate from the primary flow path, is configured to facilitate the evacuation of fluid from the printhead assembly.

20 Claims, 10 Drawing Sheets

INK DELIVERY SYSTEM AND A METHOD FOR REPLACING INK

CROSS REFERENCE TO RELATED APPLICATIONS

This is a continuation of application to Ser. No.: 10/976,670, filed: Oct. 29, 2004, now U.S. Pat. No. 7,331,664 titled: An Ink Delivery System And A Method For Replacing Ink. Priority is claimed under 35 U.S.C. § 120.

BACKGROUND

Ink delivery systems are utilized by various types of printers to generate text and/or images onto a printing medium, such as paper, normally in response to communications from a computer. One particular type of ink delivery system is known as an ink jet system. Ink jet systems typically utilize cartridges as a means of storing and delivering multiple colors of ink. The cartridge typically includes a reservoir for holding a supply of ink and a printhead for depositing ink on the paper. The cartridges are located inside the printer and are configured to travel from side to side on a shaft to deposit ink on paper as dictated by the computer. The location of the entire ink jet cartridge on the shaft is known as being "on-axis."

Typically, once one of the colors is exhausted, the entire cartridge is replaced with a new cartridge. The replacement of the entire cartridge can be inefficient for at least two reasons. First, the entire print cartridge requires replacement, though only one specific color has been exhausted while the remaining colors may have sufficient ink levels for further printing. Second, although a particular color has been exhausted, the printhead is still operational, yet it is disposed of with the rest of the cartridge because, typically, an end user cannot replace an ink supply alone, without replacing printheads. These inefficiencies can lead to large expenses and waste for users of the ink jet cartridge systems. Improved ink delivery systems have been developed to alleviate the need to replace an entire multiple color ink jet cartridge, including the printhead, after a single color had been exhausted.

In an improved ink delivery system, the actual supply of the different ink colors may be located off the printer shaft, i.e., "off-axis." Only a relatively small local ink reservoir and the printhead are located on-axis. Each color has its own off-axis supply of ink. The separate ink supplies allow for the replacement of a particular color after being exhausted rather than having to unnecessarily replace an entire cartridge that has not been completely depleted or replace printheads that are still operational.

While the improved ink delivery systems allow users to replace ink supplies that have been depleted, users typically must do so with the same type and color of ink. The same type and color must be used because printhead assemblies cannot be adequately purged and cleansed of one color and type of ink in preparation for a different color and type of ink.

The embodiments described hereinafter were developed in light of this situation and the drawbacks associated with existing systems.

BRIEF DESCRIPTION OF THE DRAWINGS

The present invention will now be described, by way of example, with reference to the accompanying drawings, in which.

DETAILED DESCRIPTION

A system and a method for changing and/or replacing inks in an ink jet delivery system are disclosed. The system includes a printhead assembly and a fluid supply for storing a quantity of ink or other fluid. The fluid supply may be an ink supply container or housing. The container or housing may be (though not necessarily) located off the main printer shaft, i.e, "off-axis", so that it may be easily accessed. The printhead assembly may be located on the printer shaft, i.e., "on-axis." The system includes a primary flow path to provide fluid (e.g., ink) from the fluid supply to the printhead assembly and a return flow path to facilitate the evacuation of fluid (e.g., ink) from the printhead assembly. In this way, ink in the printhead can be removed without extracting it from the nozzles of the printhead. This arrangement facilitates the ability to efficiently change and/or replace inks in an ink delivery system.

Figure 1A:
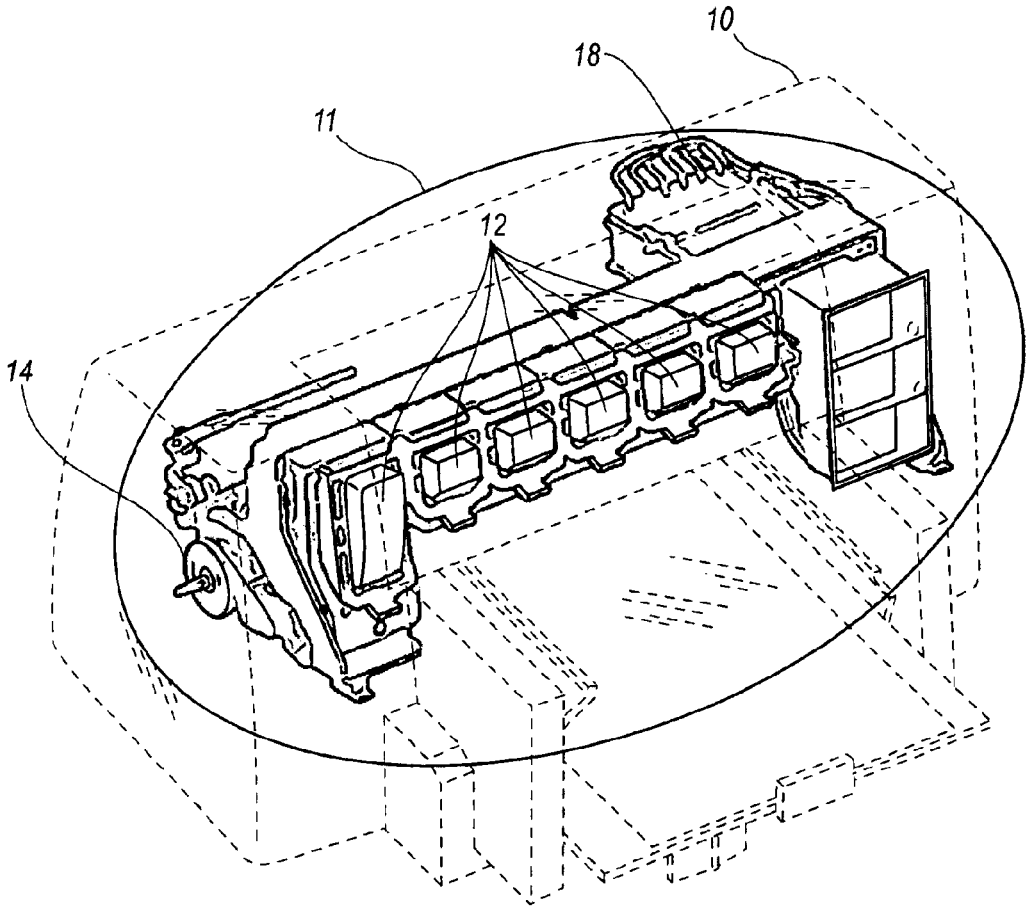
FIG. 1A is a perspective view of an exemplary printing device shown from the front including an ink delivery system according to an embodiment.
Figure 1B:
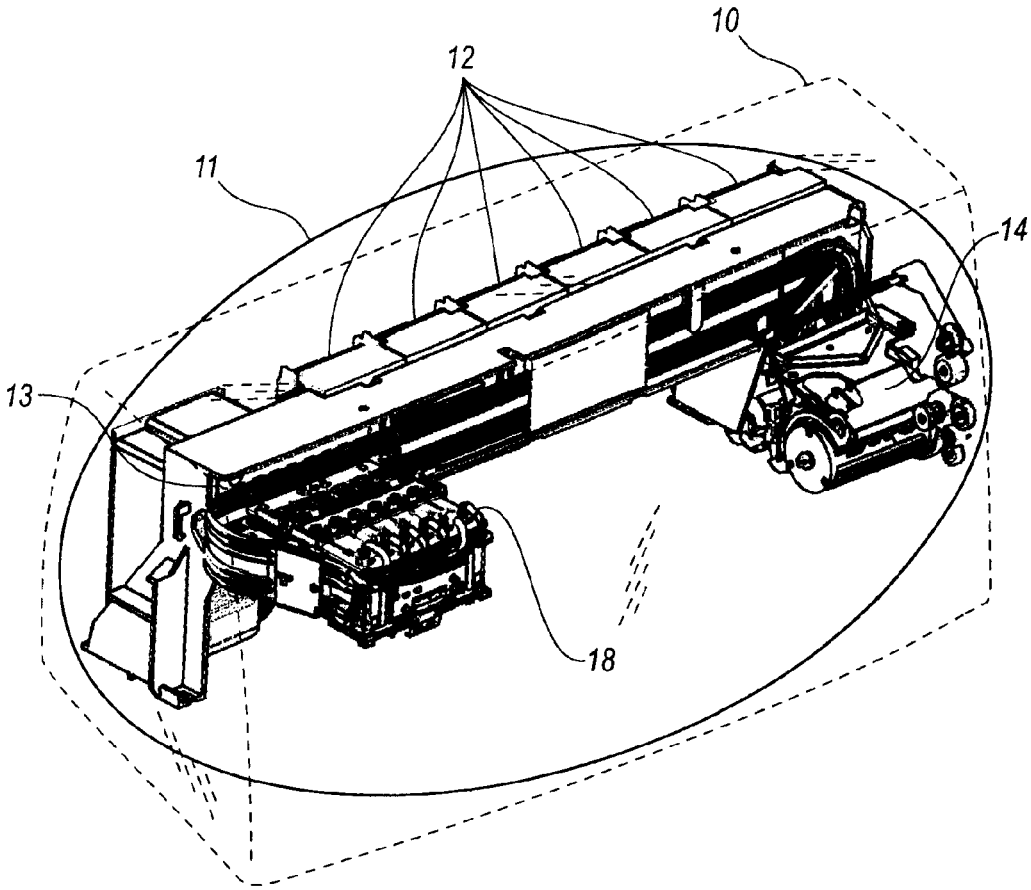
FIG. 1B is a perspective view of the printing device of FIG. 1A shown from the rear.
Figure 2:
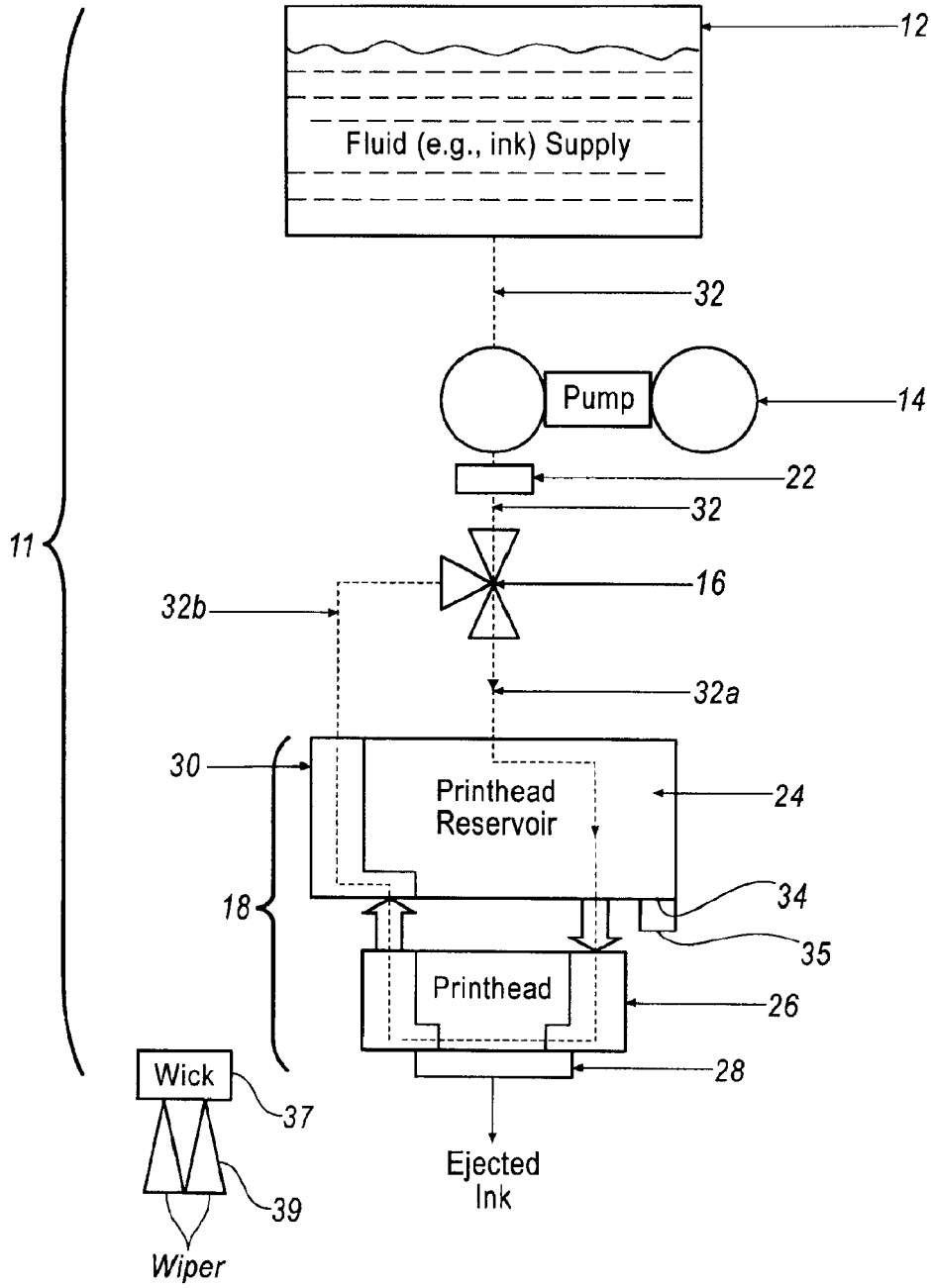
FIG. 2 is a schematic view of an exemplary ink delivery system according to an embodiment.

Referring now to FIGS. 1A, 1B, and 2, a printing device 10 is shown according to an embodiment. FIGS. 1A and 1B show front and rear perspective views respectively of printing device 10. FIG. 2 shows a functional illustration of the printing device 10. Printing device 10 is used to generate text and/or images on a printing medium, such as paper. Ink delivery system 11 is typically included in printing device 10 and is the primary mechanism to deliver ink from a fluid supply 12 through a printhead assembly 18 and onto the printing medium. The printhead assembly 18 deposits the ink onto the printing medium as it slides laterally on shaft 13. The fluid supply 12 may be an ink supply container or housing, as shown in FIGS. 1A, 1B, and 2. In this particular embodiment, ink delivery system 11 includes a pump 14, for example, a peristaltic pump or the like as known in the art. Pump 14 is configured both to force ink from fluid supply 12 to printhead assembly 18 and to draw ink from assembly 18. Pump 14 may be rotated in both a clockwise and counterclockwise direction. Ink delivery system 11 further includes a two-way valve 16 (shown in FIG. 2) for directing ink or other fluids through system 11. Valve 16 may be configured to be located within ink delivery system 11 (as shown) or, alternatively, valve 16 may be configured externally from ink delivery system 11. Fluid supply 12 is configured to be removable and replaceable with another supply (e.g., container or housing) containing the same or a different color or type of ink. In this embodiment, an out of ink sensor 22 (shown in FIG. 2) is also included in system 11 for detecting when ink has been emptied from printhead assembly 18 or fluid supply 12 and for setting the level of ink in the printhead assembly during a recharge cycle. In this embodiment, fluid supply 12 is described as being located off-axis, however it should be understood that ink delivery system 11 can function in the same manner with fluid supply 12 located on-axis and separate from printhead assembly 18.

Printhead assembly 18 includes a printhead reservoir 24 (FIG. 2) for holding a certain amount of ink on-axis prior to passage to a printhead 26. The on-axis reservoir 24 may be smaller than fluid supply 12 located off-axis. Printhead 26 includes a nozzle orifice plate 28 to deposit ink onto the printing medium. Return pipe or "snorkel" 30 is utilized by ink delivery system 11 to allow any trapped air to escape printhead reservoir 24 and printhead 26 that may accumulate during an empty routine or recharge cycle (as described hereinafter). Also, according to the embodiments described herein, snorkel 30 is utilized to draw ink from reservoir 24 and printhead 26. A primary fluid line 32*a* transports ink or other fluid from valve 16 to printhead reservoir 24 and a return fluid line 32*b* is used to transport ink or other fluid from snorkel 30 to valve 16.

Valve 16 is configured to be a two-way valve. Accordingly, ink or another fluid can be delivered and removed from printhead assembly 18 in circuit-like fashion as illustrated by the arrows in FIG. 2. Ink and cleaning fluid may be introduced into the printhead assembly 18 from fluid supply 12 in one direction when valve 16 is opened between fluid supply 12 and printhead assembly 18. When valve 16 is closed between fluid supply 12 and reservoir 24 and opened between snorkel 30 and fluid supply 12, ink or another fluid (such as a cleaning fluid, as described hereinbelow) may be drawn from printhead assembly 18 and returned to fluid supply 12. In this way, a primary flow path—for delivering ink from the fluid supply 12 to the printhead 26—is established through fluid lines 32 and 32*a* and through printhead reservoir 24 and printhead 26. Further, a return flow path—for evacuating ink from the printhead 26 and printhead reservoir 24—is established through the printhead 26, the printhead reservoir 24, and fluid tubes 32*b* and 32. In this particular embodiment, valve 16 enables fluid tube 32 to selectively be part of the primary flow path from the fluid supply 12 to the printhead 26, as well as part of the return flow path from the printhead 26 to the fluid supply 12.

Figure 3:
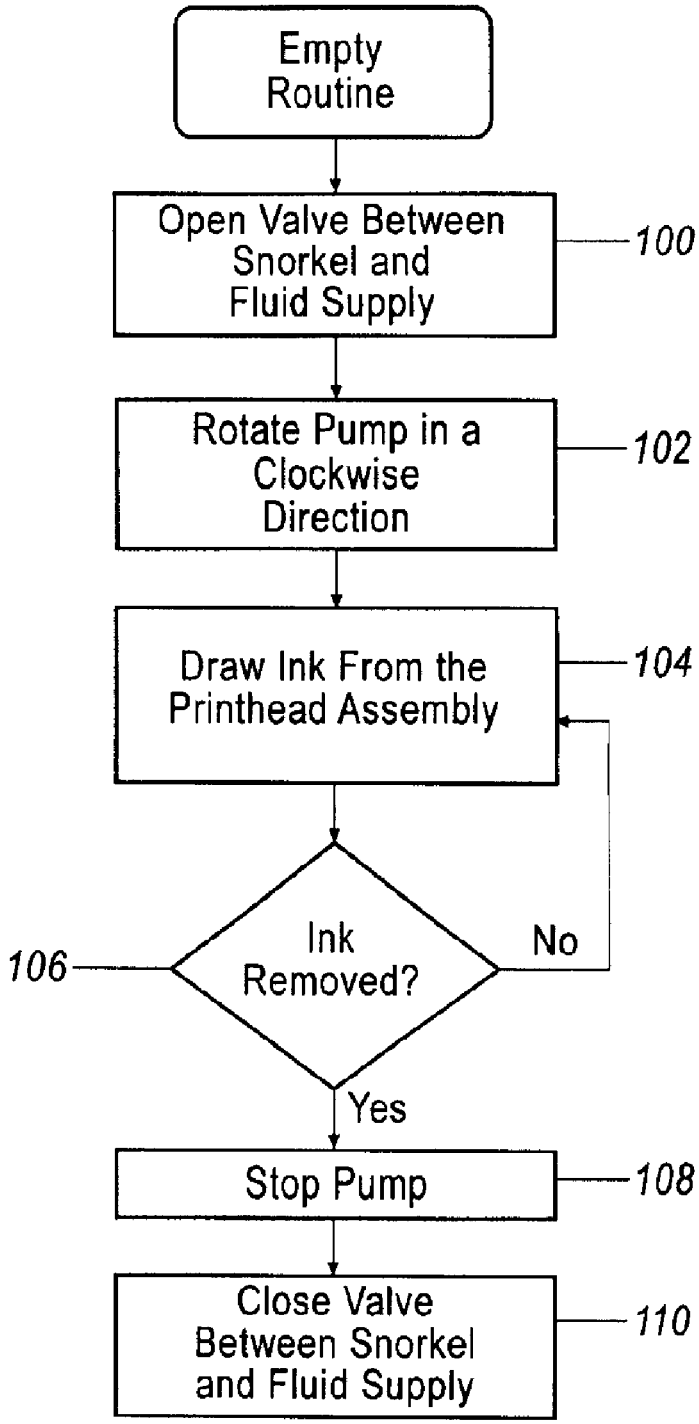
FIG. 3 is a flow diagram of an empty routine according to an exemplary embodiment.

FIG. 3 is a flow diagram illustrating procedures for emptying ink from ink delivery system 11. The removal of ink from the system is referred to as the "empty routine." In step 100, valve 16 is opened between fluid supply 12 and snorkel 30 so that fluid lines 32 and 32*b* provide a continuous flow path between snorkel 30 and fluid supply 12. Pump 14 is rotated, for example, in a clockwise direction at step 102 to draw ink from printhead reservoir 24, through printhead 26, and out of snorkel 30 at step 104. The ink continues into return fluid line 32*b*, through valve 16 into fluid line 32, and into fluid supply 12. Pump 14 will continue to operate and will pull air from printhead reservoir 24 through printhead 26 to ensure that most of the ink has been drained. In certain embodiments, some residual ink that is left behind in the system may remain trapped in corners, filters, and tubes, for example. When out of ink sensor 22 detects enough air in the fluid lines at step 106, pump 14 is stopped at step 108 and valve 16 is closed between snorkel 30 and fluid supply 12 at step 110. Most of the ink from the system is now in fluid supply 12 and may be saved for future use. Fluid supply 12 may now be replaced with a second supply (e.g., container or housing) containing a different fluid, ink color, type of ink, etc.

Figure 4:
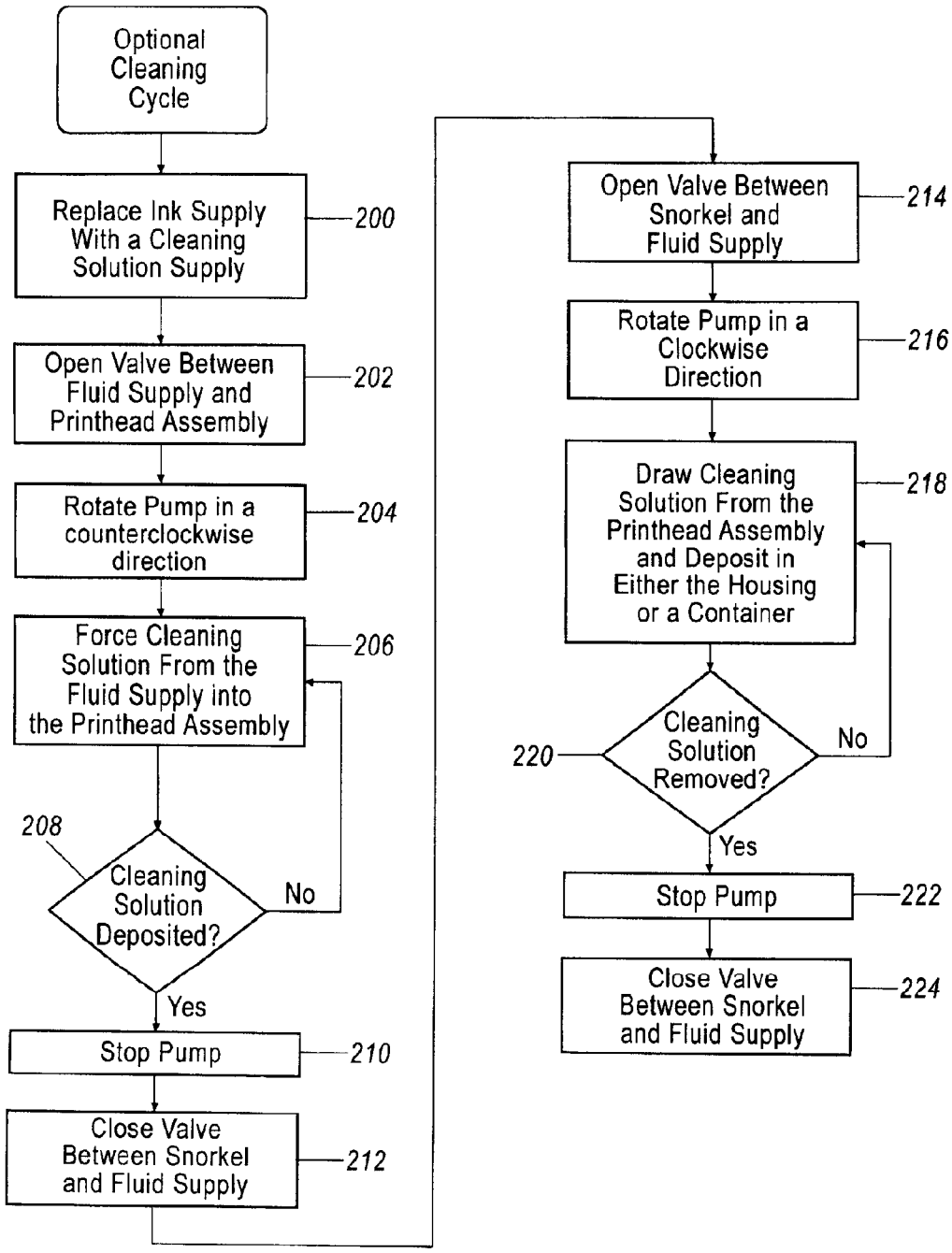
FIG. 4 is a flow diagram of a cleaning cycle according to an exemplary embodiment.

Prior to introducing a second color, a cleaning solution may be introduced into system 11 to further flush the system of residual ink. The cleaning solution may include an ink-like, dye free solution, some mixture of water, surfactants, and organic solvents, and the like. However, if the new color and type of ink being introduced contains a color and type of ink similar to the color replaced and is compatible with the type of ink being replaced, the "cleaning cycle" may be omitted. As illustrated by the procedures in FIG. 4, fluid supply 12 has been replaced by a new supply (e.g., container or housing) containing a cleaning solution and is added to system 11 at step 200. Valve 16 is opened between fluid supply 12 and printhead reservoir 24 at step 202. Pump 14 is rotated, for example, in a counterclockwise direction at step 204 and cleaning solution is forced into reservoir 24 from fluid supply 12 through fluid lines 32 and 32*a* at step 206. After depositing the cleaning fluid at step 208, pump 14 is stopped at step 210 and valve 16 is closed to reservoir 24 at step 212. Valve 16 is now opened between fluid supply 12 and snorkel 30 at step 214 to remove the cleaning solution. Pump 14 is rotated, for example, clockwise at step 216 so that cleaning fluid may be drawn from printhead reservoir 24 through printhead 26 and out snorkel 30 at step 218 and deposited in either a housing or a container to be reused later or for disposal. The process of drawing cleaning fluid from printhead assembly 18 is completed at steps 220-224. When out of ink sensor 22 detects enough air in the fluid lines at step 220, pump 14 is stopped at step 222 and valve 16 is closed between snorkel 30 and fluid supply 12 at step 110. Most of the cleaning fluid from the system is now in fluid supply 12 and may be saved for future use. Fluid supply 12 may now be replaced with a third supply (e.g., container or housing) containing a different fluid, ink color, type of ink, etc. The above cleaning cycle may be completed a number of times until the user is satisfied that the residual ink has been adequately removed from ink delivery system 11.

Figure 5:
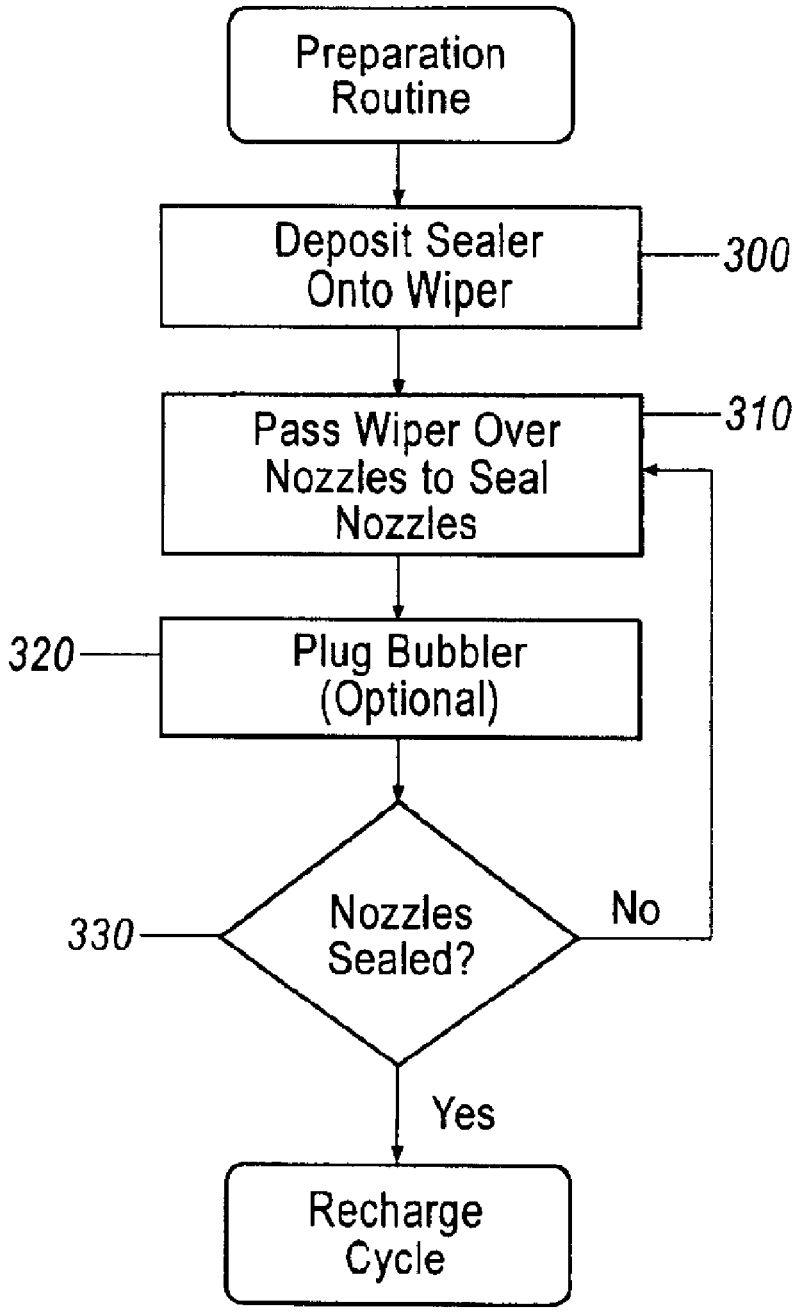
FIG. 5 is a flow diagram of a preparation routine according to an exemplary embodiment.
Figure 6:
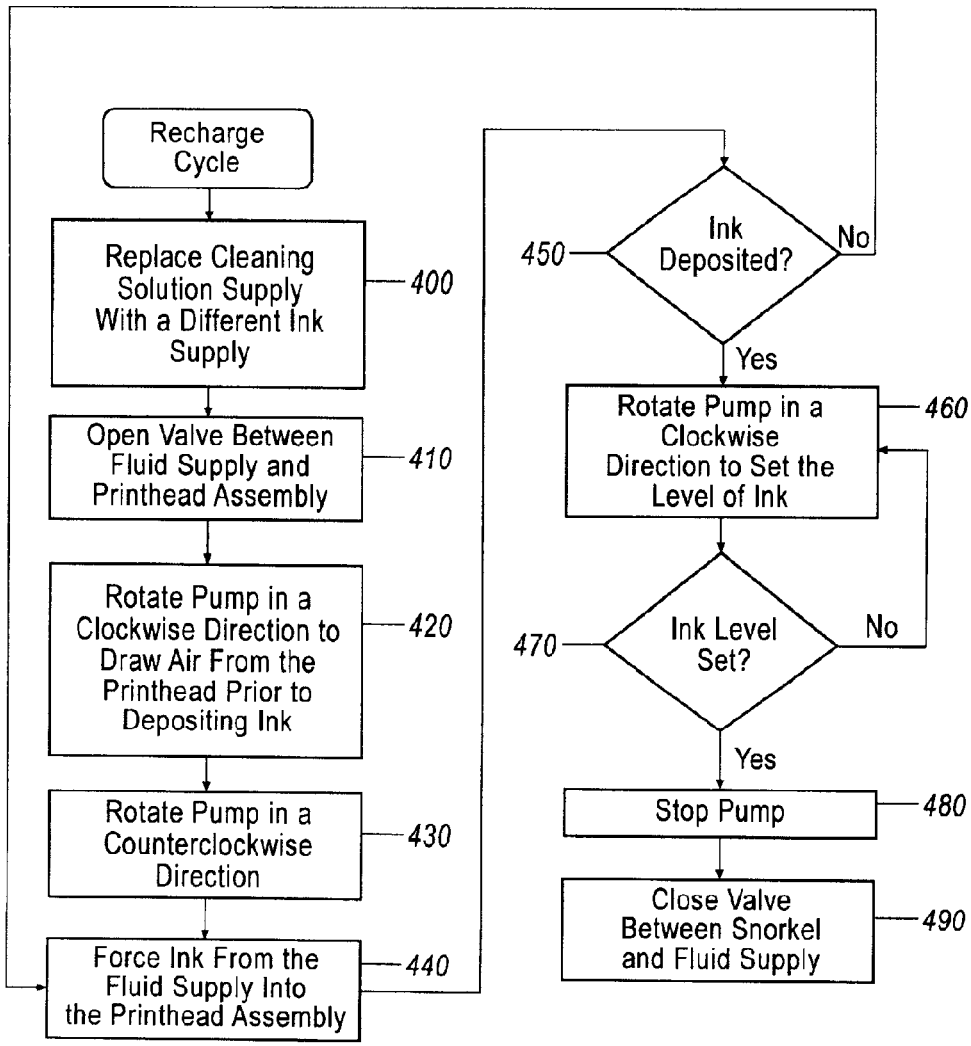
FIG. 6 is a flow diagram of a recharge cycle according to an exemplary embodiment.

When the user is satisfied that ink delivery system 11 has been sufficiently cleaned or, alternatively, the user desires to switch to a second color without utilizing the cleaning process, a new fluid supply 12 may be installed that contains a new color or type of ink (shown at step 400 in FIG. 6). Once the new fluid supply is installed, system 11 may begin the process of introducing the new color ink into printhead assembly 18. FIG. 6 illustrates procedures for introducing a new ink into system 11; also known as the "recharge cycle." Prior to the recharge cycle, an optional "preparation routine", illustrated by the procedures in FIG. 5 at steps 300-330, may be completed to seal the nozzles of nozzle orifice plate 28 and, optionally, to seal bubblers 34 with a bubbler plug 35 (FIG. 2) if the time between the cleaning cycle and the recharge cycle is such that bubblers 34 may dry out. A sealer, such as Dipropylene glycol or other suitable sealer is deposited onto from a wick 37 onto a wiper 39 (FIG. 2) at step 300. At step 310, wiper 39 is passed over nozzles of nozzle orifice plate 28 to seal the nozzles. Optionally, at step 320, bubblers 34 may be sealed with a bubbler plug 35. Prior to commencing a recharge cycle, ink delivery system 11 ensures that the nozzles are sealed at step 330.

Sealing the nozzles and, optionally, plugging the bubbler is known in the art to ensure that they do not dry out. It is beneficial to ensure that the nozzles and bubbler remain moist so that a back pressure may be maintained within printhead assembly 18. Sealing the nozzles and plugging the bubbler ensure that the components remain moist and maintain their integrity as wetted air paths. If the nozzles and bubbler dry out, air may be allowed to enter the printhead assembly through the nozzles or bubbler, thereby disrupting the back pressure, which may lead to drooling ink during later printer operations.

Once the preparation routine has been completed, the recharge cycle (FIG. 6) may commence. Valve 16 is opened between fluid supply 12 and printhead reservoir 24 at step 410 and pump 14 is rotated, for example, in a clockwise direction to draw air from the reservoir and prepare reservoir 24 to accept a new supply of ink at step 420. After preparation of the reservoir, the pump 14 is rotated, for example, in a counter-clockwise direction at step 430 to draw ink from fluid supply 12, through fluid lines 32 and 32*a*, and into printhead reservoir 24 at step 440. Ink forced into reservoir 24 passes into printhead 26. When the ink supply has been transferred into reservoir 24 as determined at step 450, pump 14 is again rotated, for example, in a clockwise direction to pull some ink from the reservoir and set the ink level at step 460. In this exemplary embodiment, out of ink sensor 22 is used to set the proper level of ink in assembly 18 to insure quality ink printing as determined at step 470. When the supply of ink has been set in reservoir 24, pump 14 is stopped at step 480 and valve 16 is closed between fluid supply 12 and printhead reservoir 24 at step 490.

Figure 7:
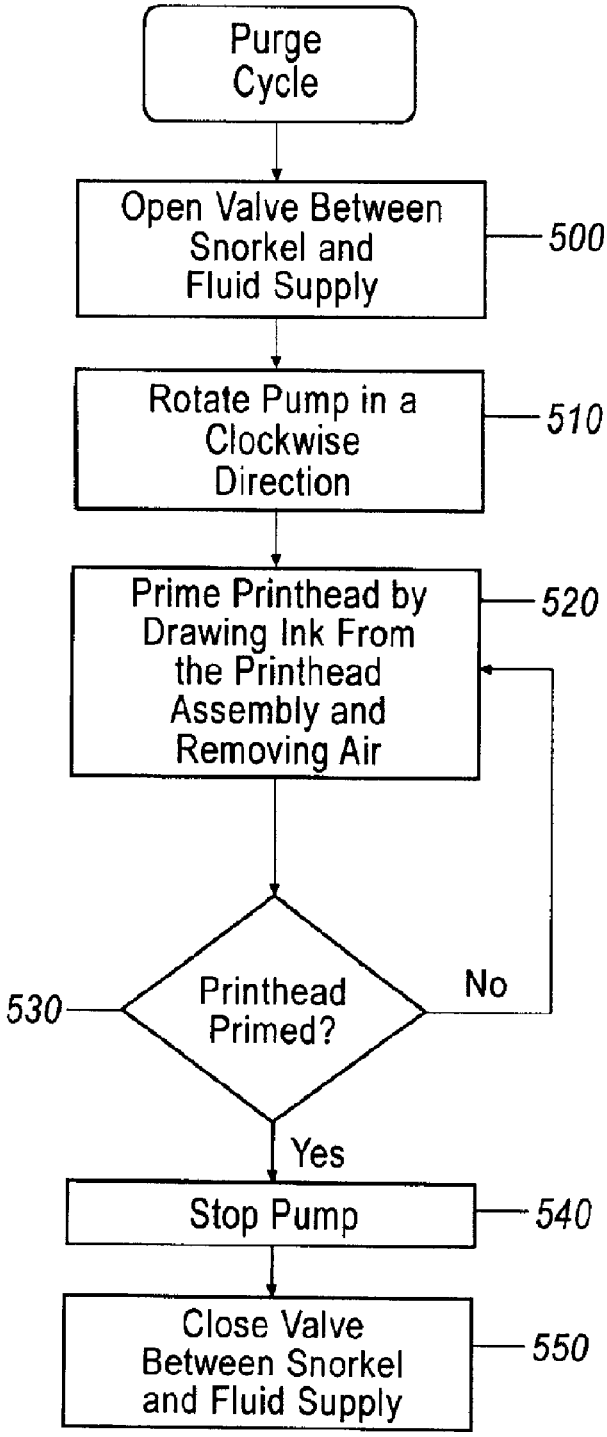
FIG. 7 is a flow diagram of a purge cycle according to an exemplary embodiment.

Thereafter, valve 16 is opened between fluid supply 12 and snorkel 30 at step 500 to complete a "purge cycle" as illustrated in FIG. 7. During the purge cycle, pump 14 is rotated, for example, in a clockwise direction at step 510 to draw air and a small amount of ink from printhead assembly 18 at step 520. In this manner, any air remaining in printhead assembly 18 may be evacuated prior to beginning a print job. When the printhead has been primed as determined at step 530, pump 14 is stopped at step 540 and valve 16 is closed at step 550. This will assure that the ink will flow freely and uniformly from printhead reservoir 24 through printhead 26 and nozzle 28 to ensure a quality ink application to the printing medium.

Figure 8:
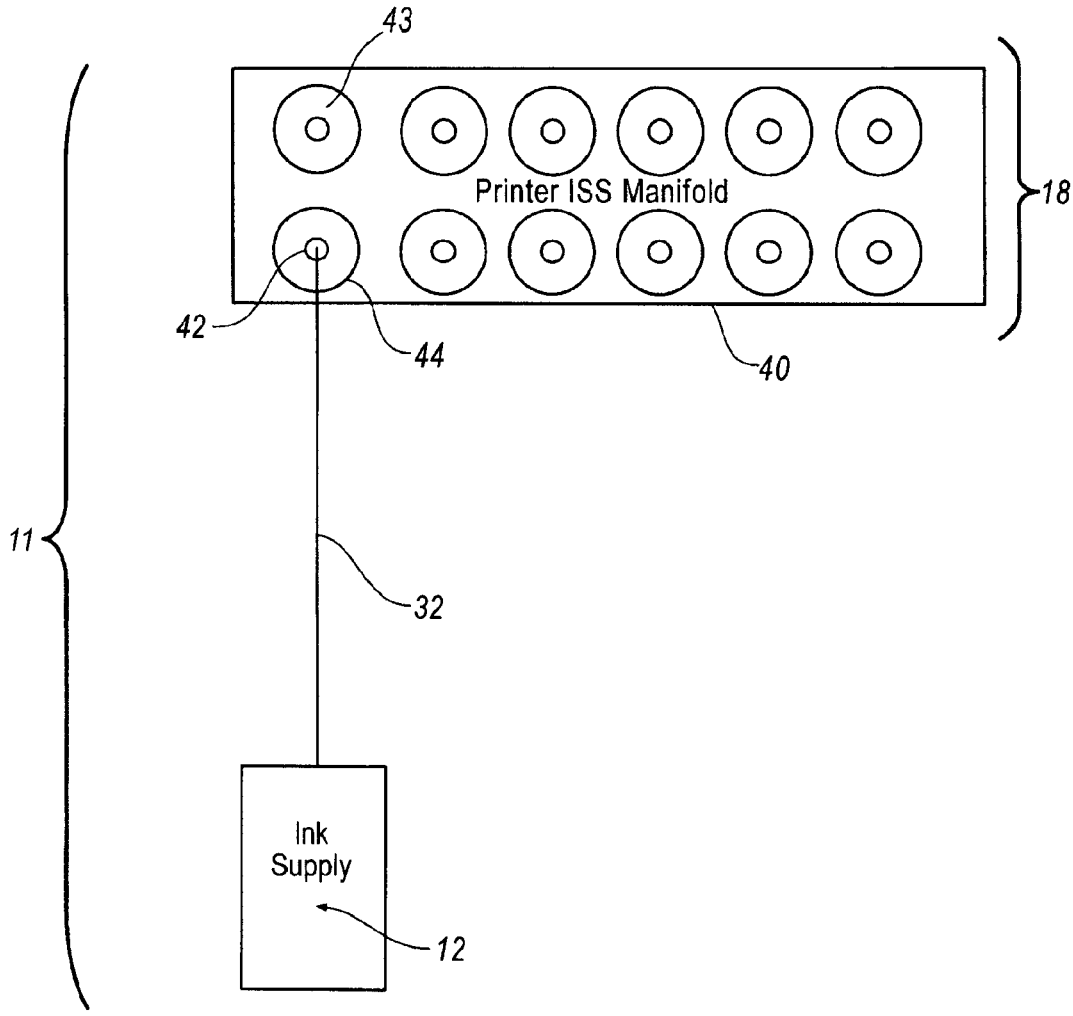
FIG. 8 is a schematic view of an exemplary ink delivery system showing an ink supply station manifold according to an embodiment.

A single ink delivery system (such as ink delivery system 11 in FIGS. 1A and 1B) may contain a number of different printheads within printhead assembly 18 (FIGS. 1A and 1B) as well as their associated fluid supplies 12 for holding inks. FIG. 8 schematically illustrates an ink supply station (ISS) manifold 40 that is an interface for a number of fluid supplies. Each fluid supply 12 and printhead assembly 18 are adapted to hold and print a different color or type of ink. FIG. 8 illustrates an example of a single fluid supply 12 connected to ISS manifold 40. In this particular illustration, ISS manifold 40 is capable of servicing six separate printhead assemblies with six separate ink supplies that are configured as a part of a single system 11. ISS manifold 40 may be connected to fluid supply 12 with fittings 42. Fittings 42 may be connected individually to each of the lower barbs 44 on the ISS manifold. The upper barbs 43 may be used for froth management to assure air is not trapped in system 11.

Figure 9:
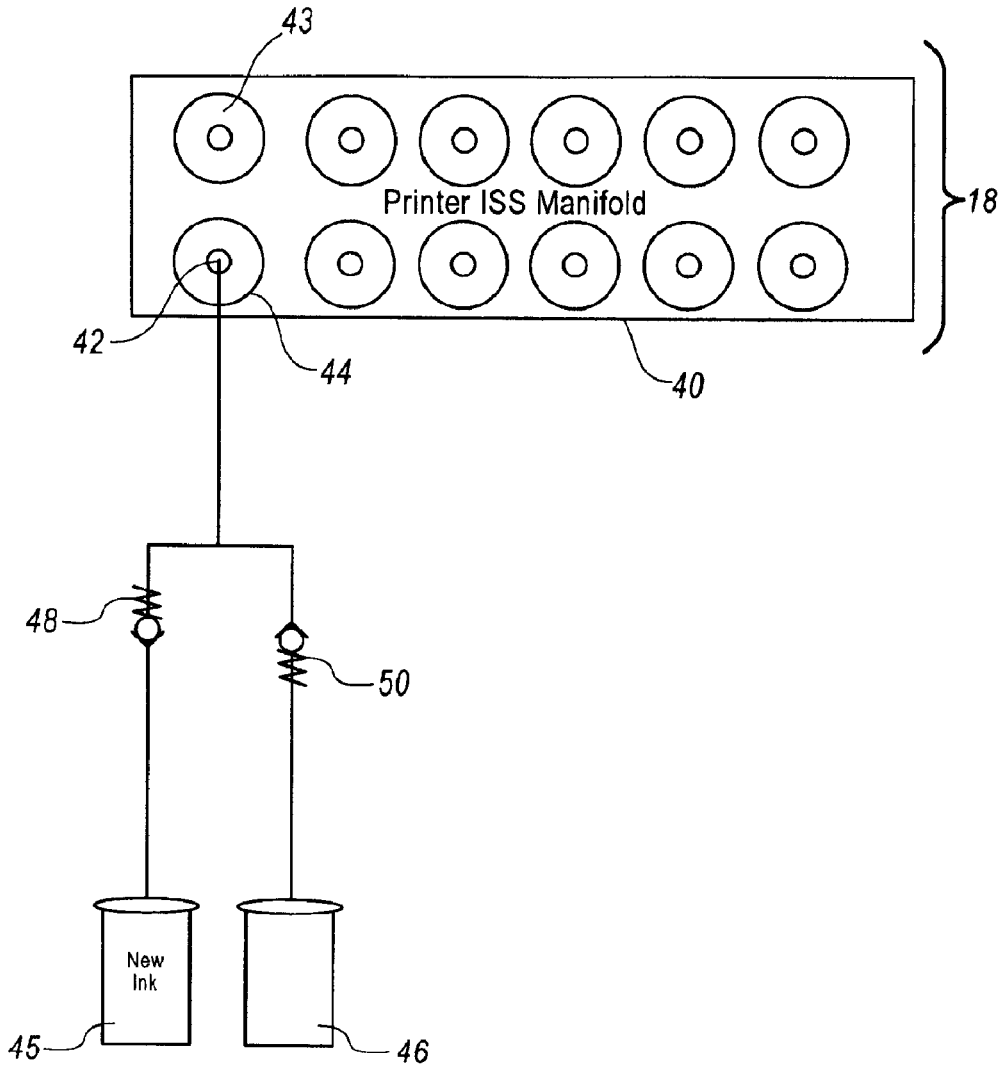
FIG. 9 is a schematic view of an enhancement to an exemplary ink delivery system having an ink supply station manifold according to an embodiment.

FIG. 9 schematically illustrates a further enhancement that could be used with the previously-described embodiment. While this enhancement may be used in a variety of settings, it is most applicable at a service center or at a home or office when used by an authorized service specialist rather than by a customer. Through this enhancement, instead of relying on fluid supply 12 to supply ink, the ink may be removed and introduced into the printhead assemblies by an out-of-printer process.

In the same manner illustrated in FIG. 8, FIG. 9 shows an ISS manifold 40 that may be connected to out-of-printer or off-line supplies with fittings 42. Fittings 42 may be connected individually to each of the lower barbs 44 on the ISS manifold or all barbs 44 may be connected to the off-line supplies at the same time with the use of a second manifold. The ink recirculation process may then be completed as generally described above. However, as the ink is removed from printhead reservoir 24 and printhead 26 (FIGS. 1A, 1B, and 2), rather than returning to an ink supply 45 for further use, the ink is deposited in a container 46 or other suitable receptacle. A new fluid may then be introduced into the system, such as new ink from ink supply 45. Two check valves 48 and 50 prevent old ink from entering the new ink supply during the empty routine and prevent new ink from entering container 46 during the recharge cycle. As described above, a cleaning cycle may be employed between the removal of the old ink and the introduction of the new ink if the inks are of incompatible colors (for example magenta and black) or incompatible chemical compounds. This procedure would enable a printer exchange or allow for not only a change in the color of inks, but also for a change in the type of inks when an improvement in the performance of inks, such as upgrading inks for light fastness or humid bleed, has been achieved.

The above-described system and methods provide significant advantages over known systems and methods. Specifically, inks in printers may be changed and/or replaced in a much more efficient and cost-effective way relative to known systems.

While the present invention has been particularly shown and described with reference to the foregoing preferred embodiment, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiment is illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

The invention claimed is:

1. An ink delivery system, comprising:

a liquid supply;

a printhead assembly, separate from and in liquid communication with said liquid supply;

a primary flow path through which liquid may be delivered from said liquid supply to said printhead assembly; and a return flow path, at least partially separate from said primary flow path, through which liquid may be evacuated from said printhead assembly;

said primary flow path and/or said return flow path including a pump and a valve operable to pump ink into said printhead assembly from said liquid supply through said primary flow path, pump substantially all of said ink remaining in said printhead assembly out of said printhead assembly through said return flow path, circulate a cleaning liquid through said primary flow path, said printhead assembly and said return flow path, and then pump more ink into said printhead assembly from said liquid supply through said primary flow path.

2. The ink delivery system of claim 1, wherein said liquid supply is located off-axis.

3. The ink delivery system of claim 2, wherein said valve comprises a valve positioned between said printhead assembly and said off-axis liquid supply that merges said separate portions of said primary flow path and said return flow path.

4. The ink delivery system of claim 3, wherein said valve comprises a two-way valve.

5. The ink delivery system of claim 1, wherein said liquid supply is located on-axis.

6. The ink delivery system of claim 1, wherein said return flow path is configured to return ink from said printhead to said liquid supply.

7. The ink delivery system of claim 1, wherein at least a portion of said return flow path is contained within said printhead assembly.

8. The ink delivery system of claim 7, wherein said portion of said return flow path contained within said printhead assembly includes a snorkel.

9. The ink delivery system of claim 1, wherein said printhead assembly includes a printhead and a printhead reservoir, and wherein at least a portion of said return flow path comprises a path in said printhead and a path in said printhead reservoir in liquid communication with each other.

10. The ink delivery system of claim 1, wherein at least a portion of said primary flow path is a supply tube coupled to said printhead assembly and at least a portion of said return flow path is a return tube coupled to said printhead assembly.

11. The ink delivery system of claim 1, further comprising an off-axis receptacle, separate from said liquid supply, coupled to said return flow path to receive evacuated liquid from said printhead assembly.

12. The ink delivery system of claim 11, further comprising a return valve positioned upstream of said off-axis receptacle, said return valve being configured to prevent liquid in said receptacle from flowing out of said receptacle toward said printhead assembly.

13. The ink delivery system of claim 12, further comprising a supply valve positioned downstream of said liquid supply, said supply valve being configured to prevent liquid from back-flowing into said liquid supply.

14. The ink delivery system of claim 1, wherein said liquid supply comprises a plurality of said liquid supplies, each liquid supply being in liquid communication with said printhead assembly.

15. The ink delivery system of claim 1, wherein said primary flow path and/or said return flow path including a pump and a valve operable to pump liquid into said printhead assembly from said liquid supply through said primary flow path, pump substantially all of said liquid remaining in said printhead assembly out of said printhead assembly through said return flow path, and then pump more liquid into said printhead assembly from said liquid supply through said primary flow path comprises said primary flow path and/or said return flow path including a pump and a valve operable to pump a first ink into said printhead assembly from said liquid supply through said primary flow path, pump substantially all of said first ink remaining in said printhead assembly out of said printhead assembly through said return flow path, and then pump a second ink into said printhead assembly from said liquid supply through said primary flow path.

16. The ink delivery system of claim 15, wherein said pump and said valve are further operable to, after pumping substantially all of said first ink out of said printhead assembly and before pumping said second ink into said printhead assembly:

pump a cleaning liquid into said printhead assembly from said liquid supply through said primary flow path; and then pump substantially all of said cleaning liquid out of said printhead assembly through said return flow path.

17. The ink delivery system of claim 15, wherein said pump and said valve are further operable to, after pumping said second ink into said printhead, prime the printhead assembly with said second ink.

18. A liquid delivery system for an inkjet printhead, comprising:

a printhead assembly;

a primary flow path through which liquid may be delivered to said printhead assembly;

a return flow path, at least partially separate from said primary flow path, through which liquid may be evacuated from said printhead assembly;

said primary flow path and/or said return flow path including a pump and a valve operable to deliver ink into said printhead assembly through said primary flow path, evacuate substantially all of the ink from said printhead assembly through said return flow path, circulate a cleaning liquid through said primary flow path, said printhead assembly and said return flow path, and then deliver more ink into said printhead assembly through said primary flow path.

19. The liquid delivery system of claim 18, wherein:

said primary flow path and/or said return flow path operable to deliver ink into said printhead assembly through said primary flow path comprises said primary flow path and/or said return flow path operable to deliver a first ink into said printhead assembly through said primary flow path; and said primary flow path and/or said return flow path operable to deliver more ink into said printhead assembly through said primary flow path comprises said primary flow path and/or said return flow path operable to deliver a second ink different from the first ink into said printhead assembly through said primary flow path.

20. The liquid delivery system of claim 18, wherein said primary flow path and/or said return flow path includes a pump and a valve.

* * * * *